United States Patent [19]

Hollenbach

[11] Patent Number: 4,567,932

[45] Date of Patent: Feb. 4, 1986

[54] VACUUM MOULDING FLASK

[75] Inventor: Horst Hollenbach, Offenbach am Main, Fed. Rep. of Germany

[73] Assignee: M.A.N.-Roland Druckmaschinen Aktiengesellschaft, Fed. Rep. of Germany

[21] Appl. No.: 612,326

[22] Filed: May 21, 1984

[30] Foreign Application Priority Data

May 21, 1983 [DE] Fed. Rep. of Germany ..... 3318702

[51] Int. Cl.[4] ..... B22C 9/02

[52] U.S. Cl. ..... 164/160.1; 164/7.1; 425/388; 425/405 R; 425/504

[58] Field of Search ..... 425/405 R, 504, DIG. 60, 425/388; 164/7.1, 7.2, 160.1, 160.2; 264/87, 101, 102

[56] References Cited

U.S. PATENT DOCUMENTS

| | | | |
|---|---|---|---|
| 26,793 | 1/1860 | Smith et al. | 425/197 |
| 791,111 | 5/1905 | Du Pont | 425/198 |
| 1,768,365 | 6/1930 | MacFarlane | 425/198 |
| 3,825,058 | 7/1974 | Miura et al. | 164/7.2 |
| 3,861,447 | 1/1975 | Hondo | 164/160.2 |
| 4,009,747 | 3/1977 | Miura et al. | 164/160.2 |
| 4,233,017 | 11/1980 | Lucas et al. | 425/302.1 |

FOREIGN PATENT DOCUMENTS

| | | | |
|---|---|---|---|
| EP51302 | 5/1982 | European Pat. Off. . | |
| 3123363 | 11/1982 | Fed. Rep. of Germany . | |
| 30008 | 9/1975 | Japan | 164/160.2 |
| 18216 | 6/1976 | Japan | 164/7.2 |
| 635254 | 3/1983 | Switzerland | 164/160.1 |
| 846069 | 7/1981 | U.S.S.R. | 164/160.1 |
| 929307 | 5/1982 | U.S.S.R. | 164/160.1 |

*Primary Examiner*—Willard Hoag
*Assistant Examiner*—Joye L. Woodard
*Attorney, Agent, or Firm*—Leydig, Voit & Mayer, Ltd.

[57] ABSTRACT

In a vacuum moulding flask, air is removed by suction from the flask, which has been filled with moulding sand, in order to consolidate the mould. To ensure satisfactory distribution of the vacuum, suction pipes are disposed inside the flask and the suction tubes must be resistant to the thermal and mechanical stresses during moulding. The suction surfaces are either cylindrical or plane and are covered by parallel, substantially triangularly-shaped profile wires so arranged as to define narrow nozzle-shaped gaps through which the air can be sucked away.

3 Claims, 2 Drawing Figures

VACUUM MOULDING FLASK

FIELD OF THE INVENTION

The present invention relates generally to a vacuum moulding flasks and more particularly concerns such a flask having at least one suction pipe extending therethrough with suction surfaces directed towards the inside of the flask.

BACKGROUND OF THE INVENTION

In vacuum moulding, the mould is usually consolidated by suction removal of the air present in the moulding sand with the mould surface being covered by a foil or the like and thus made airtight. To increase the air throughput during the suction removal step, suction pipes are generally provided in the flask and are embedded in the moulding sand. The suction pipes and the flask have suction surfaces in the moulding sand and these suction surfaces must, like screen or mesh surfaces, be formed with apertures smaller than the minimum grain size of the moulding sand.

In the rugged operating conditions of casting, the suction surfaces are stressed by high temperatures and severe mechanical loads. These surfaces, which often take the form of fine wire screens, therefore usually have special support structures, the aim of which is to ensure that the suction surfaces are not damaged which would permit the moulding sand to be sucked away resulting in undesirable penetration of the casting material into the flask.

Means for protecting vacuum lines and suction pipes in vacuum moulding flasks, of course, are known in the prior art. For example, German Utility model No. 8 029 438 discloses a vacuum moulding box wherein a perforate tube is covered with a fine-mesh wire fabric. The fabric is to a large extent covered by perforate metal strips which are secured externally above the wire fabric on the perforate tube so that the apertures in the strips register with the apertures in the tube. However, the fine wire fabric used for the screen surface has the major disadvantage of being very severely stressed when being woven. Moreover, the stressing conditions which occur during casting also tends to age the wire material very rapidly causing breaks at the bends. Consequently, apertures larger than the minimum grain size of the sand are created in the wire fabric, so that moulding sand is sucked away. The severe thermal aging experienced by the wire fabric cannot be prevented by the additional protection provided by the metal strips, even though a minor portion of the mechanical stressing can be kept away from the wire fabric.

German patent specification No. 3 123 363 also discloses an apparatus for the preparation of moulds with vacuum lines in the flask interior. To prevent damage to the flask, the vacuum lines are connected to a common vacuum collector duct on at least one wall of the flask. Disposed between such ducts and the vacuum lines is a screen facility in the form of two parallel screens, one of which closes the duct and the other the vacuum lines and the space between the screens is filled with moulding sand when the mould is prepared. The aim of this step is to prevent moulding material from entering the flask in the event of damage to the suctin pipes or vacuum lines. The arrangement disclosed in this patent also employs a delicate screen surface of the vacuum lines, for instance, in the form of fine wire fabric. Here too, therefore, aging of the known wire fabric is a serious disadvantage and the cost of obviating any risk of damage is very high. Although moulding can be facilitated by variability in the disposal of the vacuum line, the flask nevertheless becomes complicated. Also, the air resistance is increased considerably by the additional layer of sand, so that suction removal of air by the vacuum lines and stable vacuum throughout the flask cannot be guaranteed.

SUMMARY OF THE INVENTION

It is therefore a principal object of the present invention to simplify and cheapen the suction tube construction and surfaces and to improve their aging in respect of thermal stressing and mechanical strength, without any impedence of the build-up of vacuum in the flask.

According to the invention, therefore, the suction surfaces of the suction pipe and of the vacuum lines are formed by parallel profiled wires which define narrow gaps that widen in the suction withdrawal direction.

In the preferred embodiment, the suction tubes are covered by substantially triangular-shaped profile wire with rounded corners. The profile wire is helically wound around the tubes like a helical spring and the convolutions are welded to a number of bars, rods or the like disposed on the inside of the tube so that the bars maintain the wire at the necessary gap width. Because of the rounded corners of the wire, a gap cross-section arises in the form of a nozzle widening towards the tube interior. The apertures of the vacuum lines in the internal walls of the flask itself can also be covered by planar gap filters comprised of a number of profile wires, disposed parallel to one another and spaced at the required gap width with the profile wires being welded to bars, rods or the like disposed perpendicularly to the wires.

A very advantageous feature of this kind of suction pipe is that the screen part and the support structure are integral. The gapped tubes and walls are thus inherently very stable and little affected by mechanical pressure and temperature effects. The aging phenomena which is such a hazard with the prior art woven wire fabric cannot manifest to the same extent in the solid profile wire. Also, profile wire with rounded corners is much stronger in respect of mechanical pressure and the profile wire is preferably welded to the support bars at every crossing. Another major advantage is that the gaps between the discrete convolutions have a nozzle-like cross-section, which improves the throughput of air when the same is sucked out of the moulding sand. The suction required to remove the air from the moulding sand can therefore be reduced, while the vacuum is maintained reliably and generally uniformly throughout the mould. Because of the resistance to aging and the mechanical stability of the gapped tubes, a considerable increase in working life is provided, with the result of substantial cost savings, fewer suction pipes being needed, less labor time being required to replace and repair them and less energy being necessary to operate the air suction system.

A preferred embodiment of the invention will be described hereinafter with reference to the drawings.

DESCRIPTION OF THE PREFERRED EMBODIMENT

Figure 1:
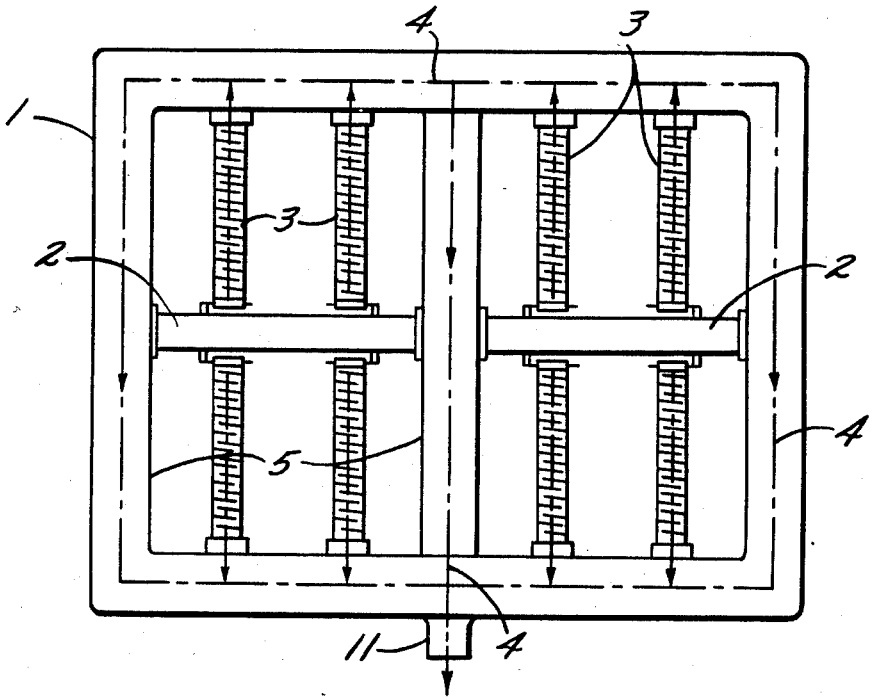
FIG. 1 is a top plan view of a moulding flask.

Turning now to the drawings in more detail, FIG. 1 shows the basic arrangement of a flask 1 such as is used for vacuum moulding. As shown here, the flask 1 is generally rectangular in shape with hollow outer walls and a hollow central partition wall with the flask 1 reinforcing structure 2 to stabilize it. Hollow suction pipes 3 extend from the hollow outer frame walls of the flask 1 and are disposed in the open interior of the flask. The pipes 3 are connected to the hollow flask frame walls but are closed towards the center of the flask and are supported by the reinforcing structure 2. The end walls and the central partition of the flask 1 have flat or planar suction surfaces 5 on their inner surfaces which extend parallel to the pipes 3. The suction surfaces 5 are connected to vacuum lines 4 (shown by dot-dash lines) formed in the hollow walls of the flask 1.

Figure 2:
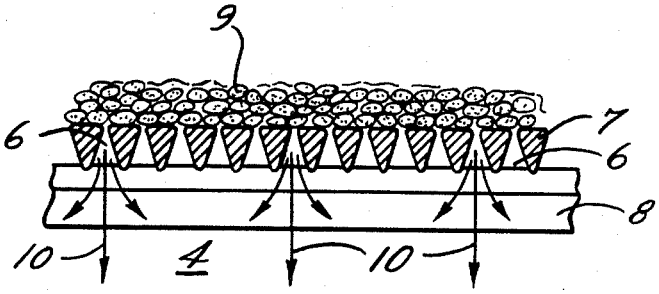
FIG. 2 is a greatly enlarged fragmentary cross-section through the wall of a suction pipe with moulding sand on it.

In accordance with the present invention, the suction surfaces of the pipes 3 and the planar suction surfaces 5 of the flask walls are covered by substantially triangular-shaped profile wires 7 disposed parallel to one another to define nozzle-like gaps or apertures 6 therebetween. As shown in more detail in FIG. 2, the triangular-shaped profile wires are welded or otherwise secured to bars, rods or the like 8 which form a relatively rigid support structure for the suction surfaces of the pipes 3 and flask walls 5. Moulding sand 9 covers the outer surface of the profile wires 7 and it will be understood that the outer opening of the gaps 6 are smaller than the minimum grain size of sand so that the sand is not drawn by suction through the nozzle-like gaps and into the suction pipes and vacuum tubes.

In evacuation of the mould, air is removed from the moulding sand 9 by being sucked away through the widening gaps 6 in the direction indicated by arrows 10. Due to the nozzle effect of the gaps 6, the throughput of air is high even though the opening of the gaps 6 are small in relation to the total area of the pipes. Additionally, the gap filter or suction surface is made extremely stable by the profile wires 7 being welded to the bars 8 at every helical convolution of a gapped tube 3 and at every crossing place in the case of a gapped screen or planar suction surface 5. Consequently, both the mechanical pressure arising from the removal of air by suction and the thermal stressing associated with entry of the casting material in the flask 1 are taken up very satisfactorily while a high air throughput and reduced power consumption for the suction are ensured.

The vacuum lines 4 in the flask walls and suction pipes 3 are connected by way of a spigot or the like 11 to a vacuum source, the size of which can be reduced because of the advantageous behavior of the nozzle-like gaps 6 with a consequent saving in energy costs and a reduction in noise.

I claim as my invention:

1. A vacuum moulding flask having an open interior and one or more vacuum lines for drawing air through one or more suction pipes extending through the flask with the suction pipes and the vacuum lines having suction surfaces directed towards the inside of the flask, characterized in that the outer surfaces of said suction pipes and vacuum lines are formed by parallel, substantially triangularly-shaped profile wires which define narrow nozzle-like gaps at the outer surfaces thereof, said gaps widening in the suction withdrawal direction.

2. A flask according to claim 1, characterized in that the suction pipe is cylindrical and is formed by a support structure comprising bars or rods which are perpendicular to the profile wire and arranged with relatively large spaces between said bars or rods, said profile wire being wound substantially helically on the support structure to form a gapped tube.

3. A flask according to claim 1, characterized in that the vacuum lines are covered towards the flask interior by planar suction surfaces formed as a gapped screen of parallel, substantially triangularly-shaped profile wires secured to a support structure, the support structure comprising a number of bars or rods which are substantially perpendicular to the wires and arranged with relatively large spaces between said bars or rods.

* * * * *